United States Patent [19]

Burd

[11] Patent Number: 4,815,408

[45] Date of Patent: Mar. 28, 1989

[54] RIGGING CLAMP AND GUAGE

[76] Inventor: Raanan Burd, 2717 Ave. P, Brooklyn, N.Y.

[21] Appl. No.: 91,525

[22] Filed: Aug. 31, 1987

[51] Int. Cl.[4] ..... B25B 25/00

[52] U.S. Cl. ..... 114/109; 7/164; 24/68 R; 52/105; 52/149; 114/223; 254/233; 254/234

[58] Field of Search ..... 114/109, 111, 223, 215, 114/216, 221 R; 24/68 R, 68 CD, 68 CT; 52/147, 148, 149, 150, 151; 254/229, 231, 232, 233, 234, 270; 7/164

[56] References Cited

U.S. PATENT DOCUMENTS

| | | | |
|---|---|---|---|
| 398,286 | 2/1889 | Speer | 254/231 |
| 413,178 | 10/1889 | Doe | 7/164 |
| 583,318 | 5/1897 | Young | 254/233 |
| 1,147,318 | 7/1915 | Fulford | 254/234 |
| 1,997,109 | 4/1935 | Fyfe | 254/232 |
| 2,071,694 | 2/1937 | Howe | 52/105 |
| 2,205,979 | 6/1940 | Horechney | 7/164 |
| 2,606,331 | 8/1952 | Daley | 7/164 |
| 3,245,649 | 4/1966 | Cassidy et al. | 52/149 |

FOREIGN PATENT DOCUMENTS

| | | | |
|---|---|---|---|
| 559551 | 9/1923 | France | 254/234 |

*Primary Examiner*—Sherman D. Basinger
*Assistant Examiner*—Thomas J. Brahan

[57] ABSTRACT

A clamping device adapted to receive respectively in each of two linearly spaced members the distill end of a shroud line and a deck plate mount, the members being moveable along a threaded shaft to draw the distall end of the shroud line toward the deck plate member for attachment thereto; and a guage for determining precisely the linear relationship between the distill end of the shroud line and the deck plate.

2 Claims, 1 Drawing Sheet

RIGGING CLAMP AND GUAGE

BACKGROUND OF THE INVENTION

The present invention concerns improvements in a means for effecting controlled attachment of the shroud lines attached to the masts of sailing vessels to a deck plate mount.

Typically, the masts of sailing vessels are supported in a generally vertical position by several shroud lines which are connected adjacent to the top of the mast and at the lower or distill end, to the deck of the vessel. In order to rig a vessel properly, the shroud lines attached to the mast should be placed in equal tension and should be geometrically of respective lengths to provide a mast having prescribed vertical vectors. Shroud lines on smaller sailing vessels or sail boats whose operation is primarily for pleasure are frequently attached by the owners of such vessels in an empirical manner when a vessel is rerigged or when an individual shroud line requires replacement. The person making the replacement may resort to the "feel" of the line to match the tension of an opposing shroud line while attempting to connect the distill end of the shroud line with the deck fitting. Since the connection to be made with the deck fitting is variable as to length, the results are not always optimal. This can result in unequal loading and improper alignment of the mast which effects the proper sailing of the vessel.

Various attempts have been made to provide adjustable connectors between the lines of sailing vessels and their hull connections. For example, U.S. Pat. Nos. 38,919 and 311,605 disclose such devices. Turnbuckles of the type shown in U.S. Pat. No. 4,560,147 have been proposed for this purpose. While such devices have their uses, particularly for larger sailing vessels where the rigging must sustain greater forces under sail, these devices are not readily applicable to smaller sailing vessels and sail boats generally in non-commercial use.

The present invention concerns a rigging clamp and gauge which is extremely simple in construction and which may be used by the average person to very accurately rig the shroud lines of a small sailing vessel.

SUMMARY OF THE INVENTION

In accordance with the present invention a clamping device is disclosed for attaching the distill end of a shroud line appended to a sailing mast to a deck mounted attached to the hull of a sailing vessel which includes a threaded shaft, two opposed arms each having apertures at one end to enable them to slide over said shaft and shroud engaging and deck mount engaging means at the other ends respectively, the arms being preferably made of flat sheet steel and being encapsulated along the shaft by respective pairs of nuts threaded thereto. The outer ends of each arm are adapted to engage on the one hand the distill end of a shroud line while the other arm engages the deck mount, movement of the shroud engaging arm toward the deck mount engaging arm causing the shroud connector to be moved into the deck mount connecting means so that these parts may be attached. The device of the invention further includes a gauge which is connected to the shaft and which may be used to measure precisely the relative positions of the shroud line connector within the deck mount connector.

DESCRIPTION OF A SPECIFIC EMBODIMENT

Figure 1:
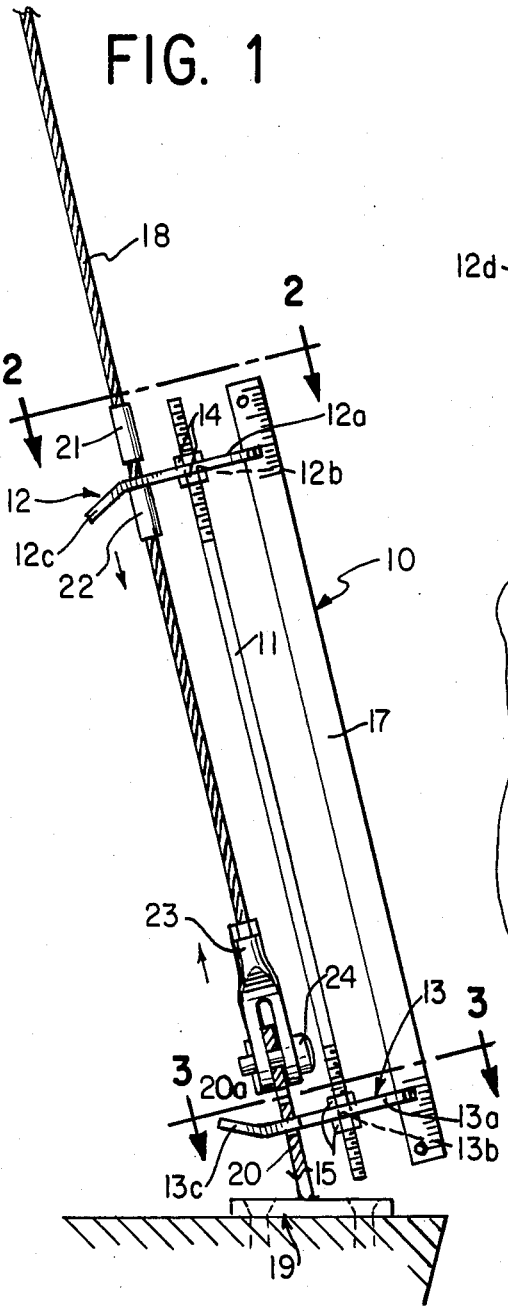
FIG. 1 is a side view of a device of the present invention as it is used to engage and couple a shroud line to a deck mount.
Figure 2:
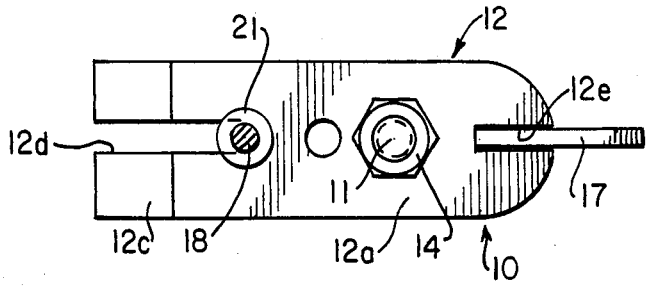
FIG. 2 is a view taken in the direction of arrows 2—2 of FIG. 1.
Figure 3:
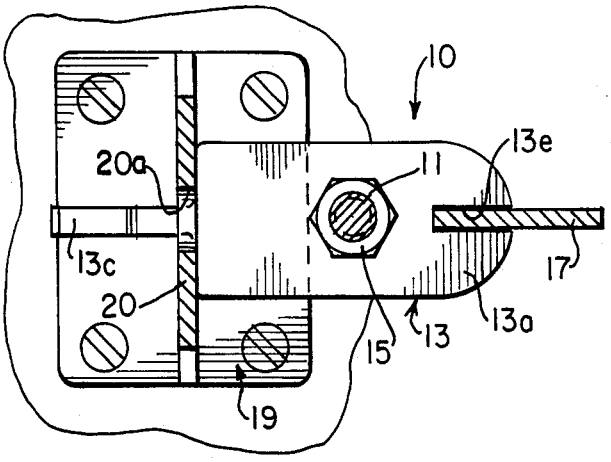
FIG. 3 is a view taken in the direction of arrows 3—3 of FIG. 1.

Referring now to the drawing and to FIGS. 1-3 thereof a rigging clamp and gauge 10 constructed according to the principles of the present invention has been illustrated. The rigging clamp and guage includes a threaded shaft 11 which in a particular embodiment may be approximately 1 foot long and ⅜ inch in diameter. Slideable thereupon are upper and lower arms respectively 12 and 23. Each of the arms 12 and 23 comprises a section **12*a*, 13*a* which has been provided with a circular opening 12*b*, 13*b* to receive shaft 11. The diameter of openings 12*b* and 13*b* is only slightly larger than the outside diameter of shaft 11 so that arms 12 and 23 may readily traverse shaft 11 with minimum frictional contact therewith while the arms 12 and 23 remain essentially in perpendicular in relation to shaft 11**.

Each of the arms 12 and 23 includes an outer section **12*c*, 13*c* Section 12*c* is bifurcated to define a slot 12*d* and Section 13*c* is formed as a finger. The width of slot 12*d* will accommodate the diameter of shroud line 18 and width of finger 13*c* accommodates inserting into an aperture 20*a* of the connecting member 20 forming part of deck plate 19**.

Sections **12*a* and 13*a* are each located between respective pairs of nuts 14 and 15. The purpose of nuts 14–15 are to clamp and secure the sections 12*a* and 13*a* between the respective pairs in whatever position along shaft 11 arms 12 and 23 may be placed. The respective pairs of nuts 14 and 15 also assure that sections 12*a* and 13*a*** of the associated arms will remain generally perpendicular to the shaft during the use of the clamp and gauge device of the invention.

The device of the present invention further includes a gauge 17 which is held within slots **12*e* and 13*e* in parallel relation to the shaft 11 and in a manner which will permit arms 12 and 23 to be freely moveable toward and away from each other together with nuts 14 and 15 along the shaft. Sections 12*a* and 13*a* of arms 12 and 23 extend toward the inner edge of gauge 17 so that the graduations thereupon can be precisely related to the position of arms 12 and 23**, one relative to the other.

The use of the device of the present invention will be described in connecting the distill end of shroud line 18 and deck plate 19. The shroud line has adjacent to its distill end two fittings 21 and 22 which have been swaged adjacent to the distil end of the shroud. Bifurcated arm sections **12*c* engage shroud 18 between fittings 21 and 22 while finger 13*c* of arm 23 is inserted into preferably the lower most aperture 20*a* of connecting member 20. Arms 12 and 13 are brought progressively toward each other to bring the distill end fitting 23 attached to the end of shroud line 18 toward deck plate connecting member 20. Fitting 23 is split to encompass member 20 and has been provided with a bolt hole which may be aligned with one of apertures 20*a* for insertion of a bolt 24 therethrough and attachment of the shroud line. The shroud line is securely held by the device of the present invention at all times while appropriate tension is applied to the shroud line 18 and while appropriate linear coupling of shroud fitting 23 and deck member 20 is completed. Gauge 17 should be used to measure the dimensional relation between the distill end of the shroud line and deck plate 19** and to compare such relation with respect to other shroud line connections to achieve dimensional uniformity.

The foregoing description has related to a particular embodiment of the invention and is representative. In order to understand the scope of the invention, reference should be made to the appended claims.

Nuts 14 and 15 which are the two interior nuts are brought up to the plates 12 and 23 after the connection of the deck plate and the shroud line have been connected by a bolt.

Nuts 13 and 16 are then released allowing the clamp to be removed.

Nuts 14 and and 15 remain stationary. The unit is then removed and placed on the opposite shroud line. (from port side to starboard side).

When the clamp is placed on the opposite shroud line the two nuts 14 and 15 (which have remained the same distance apart) will indicate the proper distance this shroud line must be placed.

I claim:

1. A clamping device for attaching the distill end of a shroud line to a deck mount attached to the hull of a sailing vessel comprising, a threaded shaft, two arms each defining adjacent to one end thereof apertures therethrough slightly larger than the outside diameter of said shaft, said arms being assembled by means of said apertures for slideable movement toward and away from each other upon said shaft, said arms each projecting for a distance in generally perpendicular relation to said shaft, two pairs of nuts threaded to said shaft each pair being disposed to encapsulate the end of one of said arms adjacent to the slideable connection thereof and said shaft whereby such slideable connection may be supported by each said pair and fixed selectively in relation to the length of said shaft, said arm respectively including engaging means adapted to receive respectively the distill end of said shroud line and a portion of said deck mount while said arms are in spaced apart relation, traversing movement of said arms toward each other and attendant movement of each pair of nuts effecting controlled connecting movement of said distil end of said shroud line toward and into contact with said deck mount such that the shroud line connection to the deck mount may be completed, said arms having sections projecting perpendicularly away from said shaft in opposite directions respectively to said engaging means, a linear gauge, said sections defining means for slideably receiving said gauge to permit precise measurement of the spaced apart relation between said arms.

2. The device according to claim 1 wherein said arm are constructed of flat sheet hardened steel and one of said arms defines a slot perpendicular to the axis of said shaft which is closed adjacent thereto and open at the end of said arm further removed from said shaft thereby defining a bifurcated arm section to grasp the distill end of the shroud line and the other of said arms defines a finger for insertion into said deck plate connection.

* * * * *